United States Patent [19]

Sikora

[11] 4,268,246

[45] May 19, 1981

[54] METHOD AND APPARATUS FOR METAL OBJECT HEAT TREATMENT

[75] Inventor: Orwill G. Sikora, Houston, Tex.

[73] Assignee: Chicago Bridge & Iron Company, Oak Brook, Ill.

[21] Appl. No.: 77,606

[22] Filed: Sep. 21, 1979

[51] Int. Cl.[3] ..... F27D 7/00; F27D 3/00; C21D 1/62

[52] U.S. Cl. ..... 432/4; 148/125; 266/259; 432/9; 432/85; 432/247

[58] Field of Search ..... 432/4, 9, 85, 247; 266/256, 259; 148/125

[56] References Cited

U.S. PATENT DOCUMENTS

| | | | |
|---|---|---|---|
| 1,999,832 | 4/1935 | Dreffein | 266/259 |
| 2,772,082 | 11/1956 | Hortvet | 431/8 |
| 2,885,197 | 5/1959 | Cope et al. | 432/251 |
| 3,035,819 | 5/1962 | Mescher et al. | 266/259 |
| 3,700,217 | 10/1972 | Rauskolb | 432/4 |
| 4,070,147 | 1/1978 | Sikora et al. | 432/5 |

FOREIGN PATENT DOCUMENTS

| | | | |
|---|---|---|---|
| 908449 | 10/1962 | United Kingdom | 432/9 |

*Primary Examiner*—John J. Camby

*Attorney, Agent, or Firm*—Merriam, Marshall & Bicknell

[57] ABSTRACT

Apparatus comprising a metal shell enclosing a spaced adapted to be heated, low heat retention, thermal shock resistant insulation on one substantially entire surface of the metal shell, a heater to heat the space enclosed by the metal shell, a vent for heated gases from the shell-enclosed space, a conduit and nozzle to supply atomized water into the shell-enclosed space to controllably cool the shell-enclosed space, and a vent for steam from the shell-enclosed space.

A method comprising applying a low heat retention, thermal shock resistant insulation on one substantially entire surface of a metal shell enclosing a space, heating the space enclosed by the metal shell by means of hot gases with venting of the hot gases from the shell-enclosed space, supplying atomized water into the shell-enclosed heated space to controllably cool said space, and venting steam from the cooling shell-enclosed space.

16 Claims, 6 Drawing Figures

METHOD AND APPARATUS FOR METAL OBJECT HEAT TREATMENT

This invention relates to the heat treatment of metal with controlled cooling to develop beneficial or desirable properties in the metal. More particularly, this invention is concerned with the heat treatment and controlled cooling of metal in which low heat retention, thermal shock resistant insulation is used to retard heat loss and atomized water is used for rapid controlled cooling.

The forming of many metals, and the fabrication and manufacture of goods from metals, often results in the metals having a less than desirable metallurgical condition. To convert the metals to a desired physical condition, it is common to heat the metals to a suitably high temperature and to subsequently cool the metals to ambient temperature. The temperature to which the metals are heated, the time of heating, as well as the rate of cooling, are carefully selected to develop the intended physical properties in the metal. Thus, a steel to be normalized could be heated to about 1600° F. and then cooled slowly. Tempering of steel also requires heating to a high temperature but the subsequent cooling is rapid. Stress relieving of steel, however, requires intermediate temperatures of about 1000°-1200° F. followed by controlled cooling.

Heat treatment and controlled cooling of metal objects is effected in the shop, and also in the field when the objects are too large to shop fabricate and ship to the job site.

Shop heat treatment usually employs a furnace in which the metal object is heated. The heated metal object subsequently may be cooled in the furnace or it may be removed hot from the furnace through a door or similar removable closure and be rapidly cooled at a different location.

In the field heat treatment of metal objects, a furnace may be built especially for the job and then be dismantled when the work is completed. Some objects, however, are too large for heat treatment in a furnace, whether located in the field or in a shop. Many large metal objects requiring heat treatment can nevertheless be successfully heated by converting the objects essentially into furnaces themselves. This is done by externally insulating metal tanks, vessels, reactors and the like and then supplying heat to the internal enclosed space defined by the insulated object. Sikora U.S. Pat. No. 4,070,147; Hortvet U.S. Pat. No. 2,772,082; and Norgaard U.S. Pat. No. 2,705,627 illustrates this approach to heat treatment, and also controlled cooling.

After being heated, a metal object is generally controllably cooled by means of air or water quenching. Air cooling, however, is often not fast enough to achieve the optimum cooling rate needed to develop the desired physical properties in the metal. Water quenching, while suitable for small objects, is not practical for large heavy or bulky objects. Cooling by water spray or atomization has accordingly been employed, as see Kunz U.S. Pat. No. 2,843,514 but wherein the bell or metal cover over the heated metal coil is uninsulated.

Cooling of heated objects in a furnace by means of a water spray or atomized water is not practical because the internal refractory linings used in such a furnace cannot long withstand the inherent shock cooling to which it would be subjected. Equally important is the fact that refractory insulating materials have a relatively high heat retention or storage and thus require withdrawal from them of large amounts of heat to lower the furnace interior. This effectively slows down the rate at which an object being heat treated in a furnace can be cooled. This cooling limitation also applies to heat treatment of objects used as furnaces themselves with external refractory insulation. While atomization or spraying of water inside of such an object will not result in rapid deterioration of the insulation, the cooling rate of the metal shell of the object will be unduly slowed by the need to withdraw the large amount of heat flowing from the insulation into the metal shell.

Mineral wool has been used as an insulation material on the exterior surface of a vessel being field heat treated to about 1200° F. and then air cooled. Mineral wool, however, is not a suitable insulation for repeated heating at higher temperatures because it loses its physical properties and proceeds to disintegrate. Even though mineral wool has a relatively low heat retention, and might be able to withstand the shock of atomized water cooling, it is not stable enough for satisfactory continuous use above 1200° F. Furthermore, to applicant's knowledge there has been no atomized water cooling used in conjunction with the use of mineral wool insulation for the heat treatment of metal objects followed by controlled cooling.

From the above it is believed clear that a need exists for systems, apparatus and methods of heat treating and controllably cooling a metal object at a relatively elevated or high temperature which employs an insulation material having a low heat retention with thermal shock resistance and which is capable of withstanding the high temperatures involved so that rapid controlled cooling of the heated object can be achieved using atomized or sprayed water.

According to one aspect of the invention there is provided apparatus comprising a metal shell enclosing a space adapted to be heated, low heat retention, thermal shock resistant insulation on one substantially entire surface of the metal shell, means to heat the space enclosed by the metal shell, means to vent heated gases from the shell-enclosed space, means to supply atomized water into the shell-enclosed space to controllably cool the shell-enclosed heated space, and means to vent steam from the shell-enclosed space.

The metal shell can be made of any metal which benefits from heat treatment, including carbon steel, stainless steel, other steel alloys, aluminum and high nickel alloys.

The metal shell can include a removable closure for an access opening to the shell-enclosed space.

The metal shell can comprise the body of a storage, processing or reacting vessel, and the insulation can be on the exterior surface of the vessel. In addition, the vessel can be supported by means which permits unrestrained expansion and contraction of the vessel when it is heated and cooled.

The metal shell can also be the wall of a reusable furnace for heat treating metal objects, and the insulation can be positioned on the interior surface of the metal shell. The furnace can contain a metal object to be heat treated.

According to a further aspect of the invention, there is provided a method comprising applying a low heat retention, thermal shock resistant insulation on one substantially entire surface of a metal shell enclosing a space, heating the space enclosed by the metal shell by means of hot gases with venting of the hot gases from the shell-enclosed space, supplying atomized water into the shell-enclosed heated space to controllably cool said space, and venting steam from the cooling shell-enclosed space.

In one embodiment of the method, the insulation can be on the outside of the metal shell and the metal shell can be heated and controllably cooled as described.

The metal shell used in the process can include a removable closure for an access opening to the shell-enclosed space. The metal shell used in the process can also comprise the body of a storage, processing or reacting vessel, the insulation can be on the exterior surface of the vessel, and the vessel can be heated and cooled simultaneously with the enclosed space. In such a method, the vessel can be supported by means which permits unrestrained expansion and contraction of the vessel when it is heated and cooled.

The method also includes having the metal shell as the wall of a reusable furnace with insulation on the interior surface of the metal shell, placing a metal object in the furnace enclosed space through an access opening, removably positioning a closure to close the access opening, and heat treating and controllably cooling the metal object in the furnace.

The described apparatus and process are particularly useful in heat treating metals which require heating (e.g. above 1200° F.), and is especially useful when temperatures of 1400° F. and higher must be used.

The low heat retention, thermal shock resistant insulation suitably employed in the invention will usually be made of alumina-silica fibers. One form of such fibers is produced from kaolin, a naturally occurring alumina-silica fireclay. Ceramic fibers made from kaolin have a melting point of 3200° F. and a normal use limit of 2300° F. One such product commercially available is marketed under the name KAOWOOL in blankets, bulk and strip products. It is characterized by low thermal conductivity, low heat storage and an extreme resistance to thermal shock. No binder is used to hold the fibers together in the blanket since interlacing of the fibers in blanket production provides all the binding needed.

Another ceramic fiber insulation suitable for use in the invention is marketed as CERAWOOL in blanket form. Ceramic fiber insulation made from silica fibers formed from leached silica is also suitable. A commercial ceramix fiber product marketed as FIBERFRAX in cloth form can also be used.

Glass cloth or combinations of ceramic fiber, glass cloth and mineral wool could also be produced and used.

The number of insulation layers and attachment means can vary as needed.

The insulation selected, furthermore, should be one which has its qualities restored after wetting with water or steam.

The invention will be described further in conjunction with the attached drawings, in which.

So far as is practical, the same elements or parts which appear in the various views of the drawings will be identified by the same numbers.

Figure 1:
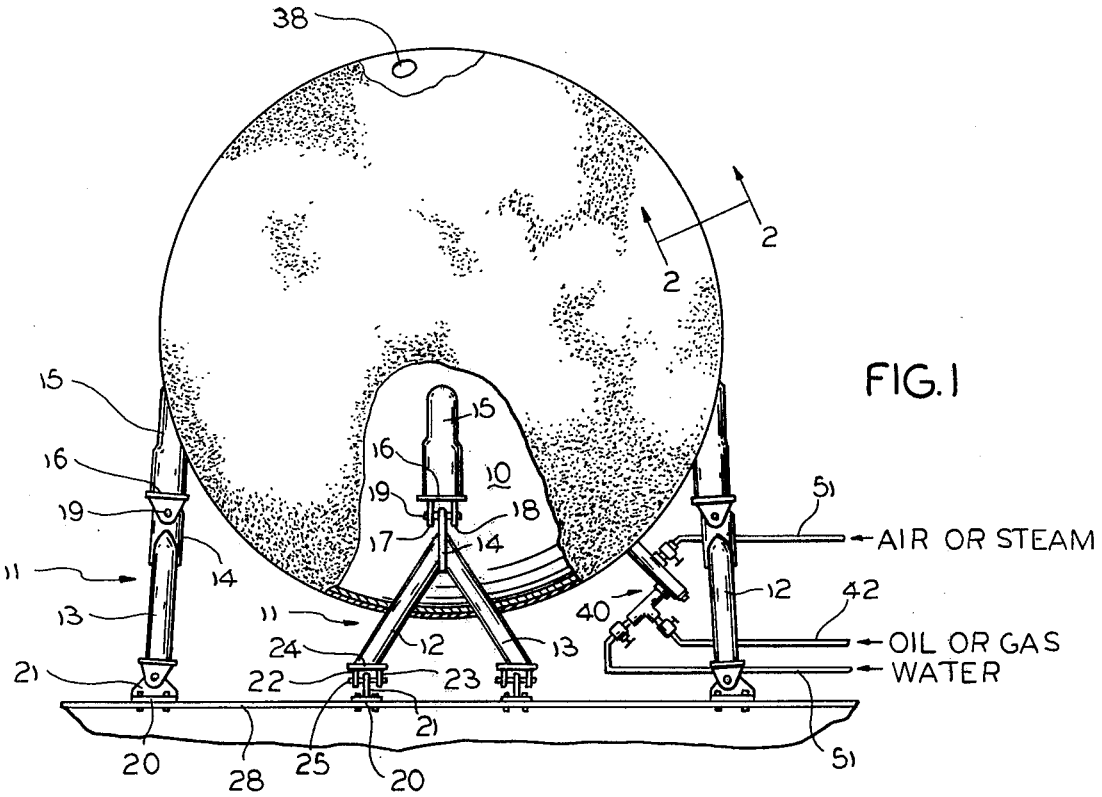
FIG. 1 is an elevational view of a spherical metal tank, externally insulated and supported for unrestrained expansion and contraction during heating and controlled cooling, and of a heating/water atomizing burner.

With reference to FIG. 1 a spherical metal vessel 10 is supported, for unrestrained expansion and contraction upon being heated and then controllably cooled, by four equally spaced apart rigid members 11 which are advisably of the same shape and construction. This support system is already disclosed in Sikora, et al. U.S. Pat. No. 3,792,795. Each rigid member 11 has a leg 12 and a leg 13. The legs are joined at their upper ends to vertical plate 14. Column stub 15 is joined to the surface of spherical vessel 10. Plate 16 is joined to the bottom end of column stub 15 and vertical flanges 17 and 18 project downwardly therefrom on each side of the upper end of plate 14. A pin 19 extends through flange 17, plate 14 and flange 18 to provide a pivotal connection of the rigid member top to the base of column stub 15.

Further in regard to FIG. 1, each leg 12 and 13 is pivotally mounted at its lower or bottom end to a base or supporting means. On plate 28 is bolted plate 20 having vertically positioned flange 21. Horizontal plate 24, at the lower end of leg 12, has a pair of downwardly depending flanges 22 and 23 which straddle flange 21. Pin 25 extends through flanges 22, 21 and 23 to complete the pivotal connection between the end of leg 12 and the supporting base structure. Leg 13 is pivotally connected at its lower end to the base structure in the same way as leg 12.

Figure 2:
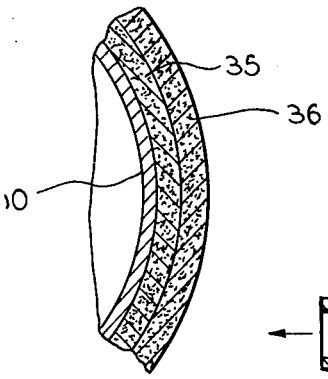
FIG. 2 is a sectional view taken along the line 2—2 of FIG. 1.

The exterior surface of vessel 10 is covered by two layers of low heat retention, thermal shock resistant insulation 35 and 36 as is shown in FIG. 2. Additional layers can be used if desired, or even one layer may be suitable sometimes. One or more openings or vents 38 are provided in the top portion of the metal shell comprising vessel 10 so that hot gases can be removed during heating and cooling of the metal shell.

Figure 3:
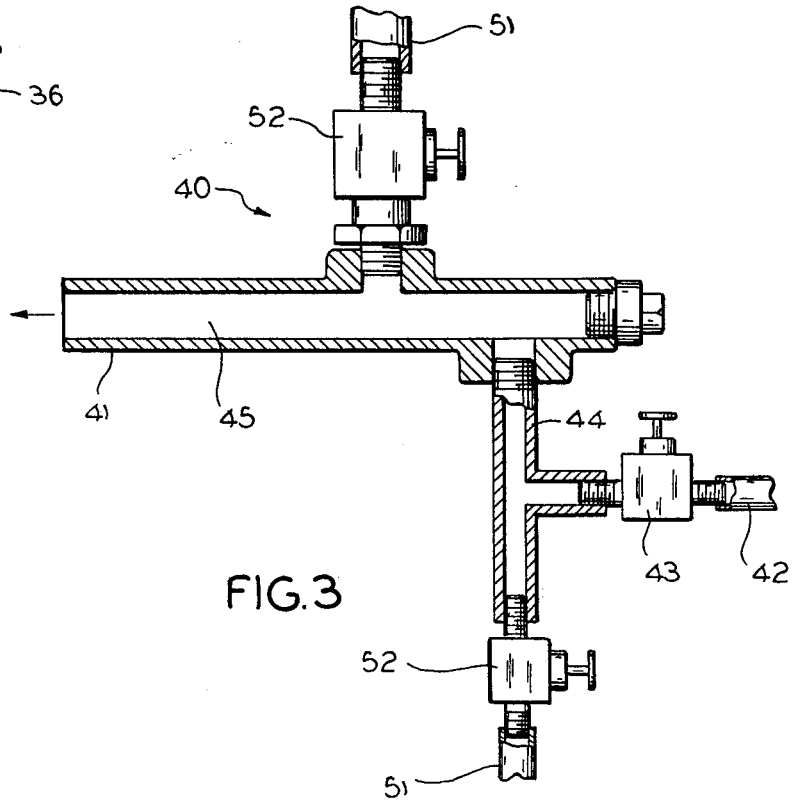
FIG. 3 is an enlarged view, partially in section, of the heating/water atomizing burner shown in FIG. 1.

As shown in FIGS. 1 and 3, at least one heating/water atomizing burner 40 is positioned adjacent the lower exterior portion of vessel 10 so that the burner neck 41 can be inserted through an opening provided therefore in the insulation 35, 36 and vessel shell.

Conduit 42 supplies a fuel, such as oil or gas, through valve 43 to conduit 44 which delivers it to the burner throat 45. Conduit 51 supplies compressed air through valve 52 to burner throat 45 where it intermixes with the fuel and forms a combustible mixture which burns at the burner mouth as a luminous flame, thereby providing heat for heating the vessel shell. If one such burner is inadequate to provide the amount of heat needed to raise the vessel shell to the temperature needed for its heat treatment, two or more such burners can be used. After the vessel is at the desired maximum temperature for the appropriate time, the fuel line valve 43 is closed. Water is then fed by conduit 51 through valve 52, which is closed when valve 43 is open, into conduit 44 and then into burner throat 45 where it is atomized by the pressurized air supplied by conduit 51. The atomized water enters vessel 10 and is converted to steam by the heat in the space inside of the vessel. The cooling achieved by the atomized water injection can be carefully controlled by the amount of atomized water fed to the vessel interior and the rate of injection. Heat radiates from the metal shell into the vessel interior and then heats the atomized water, thereby resulting in cooling of the metal shell. The ceramic fiber insulation, having low heat retention, transfers its heat rapidly by convection to the metal shell from which the heat radiates to the gaseous contents in the vessel interior space.

Figure 4:
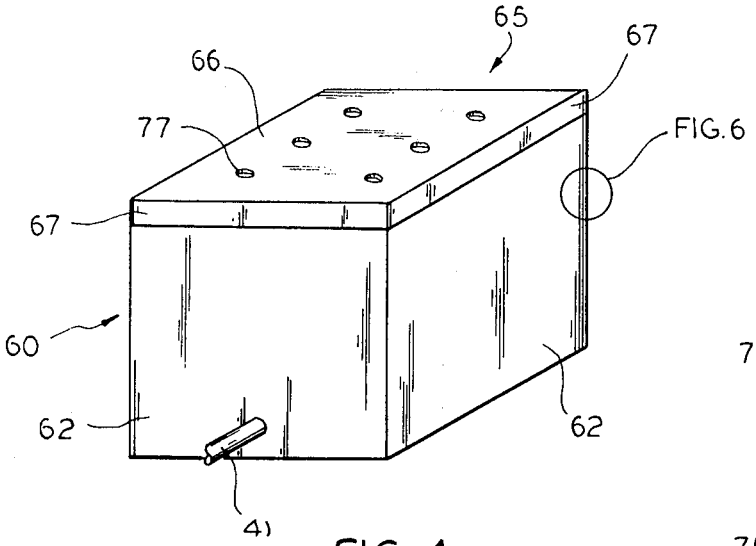
FIG. 4 is an isometric view of a furnace for heating and controllably cooling a metal object.
Figure 6:
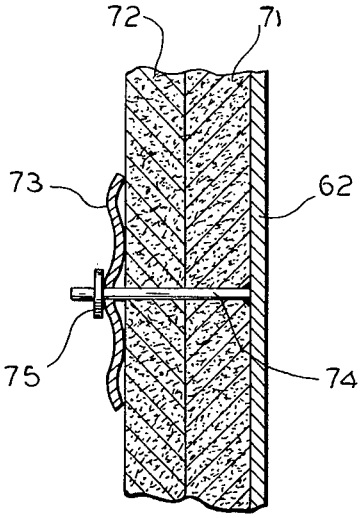
FIG. 6 is an enlarged sectional view of the wall of the furnace of FIG. 4.

FIGS. 4 and 6 illustrate a furnace 60 which can be used in the shop or field for heating and controllably cooling a metal object. The furnace 60 has a metal rectangular bottom 61 from which four vertical metal walls or sides 62 extend upwardly. The furnace 60 has a removable top 65 having a metal plate 66 and downwardly directed sides 67.

As shown in FIG. 6, the inside of furnace 60 is covered with two layers of low heat retention, thermal shock resistant insulation batts or blankets 71 and 72 which are covered by metal lath 73 held in place by studs 74 welded to the inside of the furnace metal shell and clips 75 at the stud ends. By insulating the furnace interior, the strength of the furnace structural metal shell is maintained. The layers 71 and 72 can be made of different materials with different heat retention and shock resistant properties. The layer in contact with the metal shell, or hot face, should be made of a low heat retention, thermal shock resistant insulation, such as ceramic fiber insulation.

A suitable number of openings are provided in the bottom portions of the furnace to insert the neck 41 of as many burners as may be needed to supply the heat required. Vents 77 are located in the furnace top for removing hot gases during heating and cooling of the furnace interior space.

Supports 80 are positioned inside of the furnace on the bottom for supporting a metal ring 83, or other object, to be heated and controllably cooled. Such a support, which can be made of metal or a refractory material, avoids applying the weight of the object to the ceramic fiber insulation and crushing it. The support material must, of course, be able to withstand heating and rapid cooling without failure. The support should also maintain the object high enough so that gases can flow beneath, around and through the object placed in the furnace to thereby facilitate heat transfer during heating and cooling the object. The support, in addition, must permit the object to expand and contract during heating and cooling.

Figure 5:
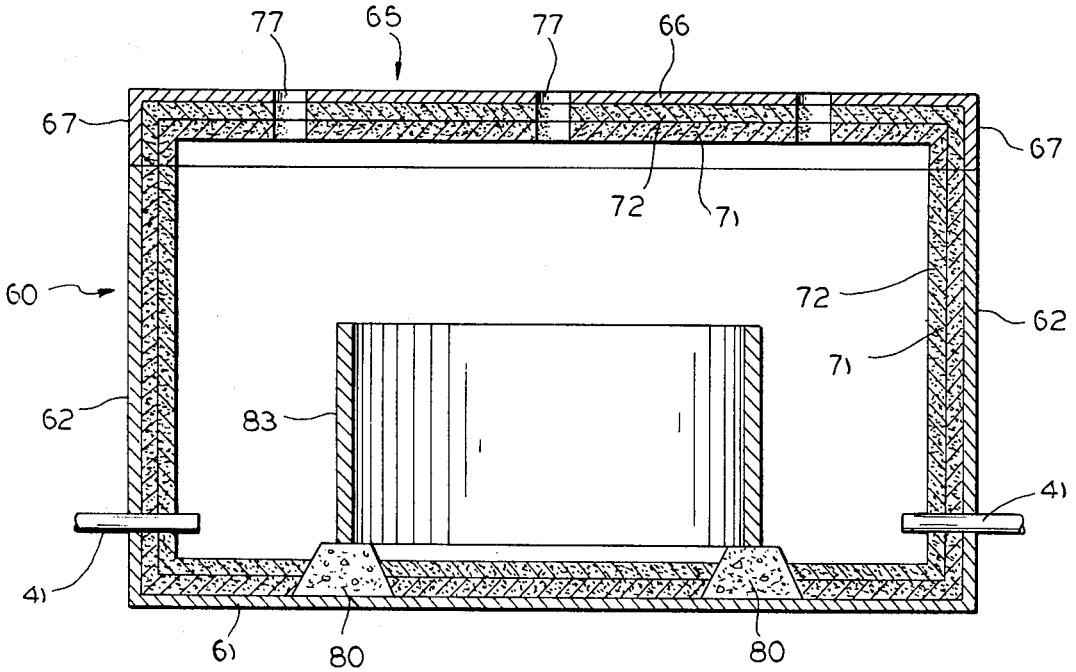
FIG. 5 is a vertical sectional view through the furnace of FIG. 4.

The furnace described with respect to FIGS. 4 to 6, is used by removing top 65, placing metal object 83 in the furnace and then replacing the top. The furnace interior is heated and cooled by operating the heating/water atomizing burner 40 as already described in conjunction with FIGS. 1 and 3.

Although the embodiments of the invention illustrated by the drawings show the use of a combination burner for heating and cooling, it is within the scope of the invention to use a separate burner and a separate device for injecting the atomized water. Furthermore, the number of burners and devices for injecting atomized water can be the same, or more or less burners than atomized water injectors can be used. The number of each employed will be determined by the temperature required and the cooling schedule to be followed.

The foregoing detailed description has been given clearing of understanding only, and no unnecessary limitations should be understood therefrom, as modifications will be obvious to those skilled in the art.

What is claimed is:

1. Apparatus comprising:

a metal shell enclosing a space adapted to be heated, low heat retention, thermal shock resistant insulation on one substantially entire surface of the metal shell, means to heat the space enclosed by the metal shell, means to vent heated gases from the shell-enclosed space, means to supply atomized water into the shell-enclosed space to controllably cool the shell-enclosed heated space, and means to vent steam from the shell-enclosed space.

2. Apparatus according to claim 1 in which the metal shell is a member of the group consisting of carbon and low alloy steel, stainless steel, aluminum and high nickel alloys.

3. Apparatus according to claim 1 in which the metal shell includes a removable closure; insulated by insulation like that on the metal shell, for an access opening to the shell-enclosed space.

4. Apparatus according to claim 1 in which the metal shell comprises the body of a storage, processing or reacting vessel, and the insulation is on the exterior surface of the vessel.

5. Apparatus according to claim 4 in which the vessel is supported by means which permits unrestrained expansion and contraction of the vessel when it is heated and cooled.

6. Apparatus according to claim 1 in which the insulation is ceramic fiber insulation.

7. Apparatus according to claim 3 in which the metal shell is the wall of a reusable furnace for heat treating metal objects, and the insulation is on the interior surface of the metal shell.

8. Apparatus according to claim 7 in which the furnace contains a metal object to be heat treated.

9. A method comprising:

applying a low heat retention, thermal shock resistant insulation on one substantially entire surface of a metal shell enclosing a space, heating the space enclosed by the metal shell by means of hot gases with venting of the hot gases from the shell-enclosed space, supplying atomized water into the shell-enclosed heated space to controllably cool said space, and venting steam from the cooling shell-enclosed space.

10. A method according to claim 9 in which the insulation is on the outside of the metal shell and the metal shell is also heated and controllably cooled as described.

11. A method according to claim 10 in which the metal shell is steel.

12. A method according to claim 9 in which the metal shell includes a removable closure for an access opening to the shell-enclosed space.

13. A method according to claim 9 in which the insulation is ceramic fiber.

14. A method according to claim 10 in which the metal shell comprises the body of a storage, processing or reacting vessel, the insulation is on the exterior surface of the vessel, and the vessel is heated and cooled simultaneously with the enclosed space.

15. A method according to claim 14 in which the vessel is supported by means which permits unrestrained expansion and contraction of the vessel when it is heated and cooled.

16. A method according to claim 12 in which the metal shell is the wall of a reusable furnace, the insulation is on the interior surface of the metal shell and a metal object is placed in the enclosed space through the access opening, the closure is positioned to close the access opening, and the metal object is heat treated and controllably cooled.

* * * * *